United States Patent [19]

Lee

[11] Patent Number: 4,542,677

[45] Date of Patent: Sep. 24, 1985

[54] CARTRIDGE PRIMER FEEDER

[76] Inventor: Richard J. Lee, 3146 Kettle Moraine Rd., Hartford, Wis. 53027

[21] Appl. No.: 622,966

[22] Filed: Jun. 21, 1984

[51] Int. Cl.[4] ..... F42B 33/10

[52] U.S. Cl. ..... 86/38; 86/36; 86/37

[58] Field of Search ..... 86/36, 37, 38, 24, 25, 86/28

[56] References Cited

U.S. PATENT DOCUMENTS

| | | | |
|---|---|---|---|
| 3,128,668 | 4/1964 | Dicken | 86/38 |
| 3,152,508 | 10/1964 | Fratila | 86/38 |
| 3,240,103 | 3/1966 | Lamont | 86/38 |
| 3,320,848 | 5/1967 | Ponsness | 86/38 |
| 3,973,465 | 8/1976 | Bachhuber et al. | 86/36 |
| 4,222,305 | 9/1980 | Lee | 86/37 |
| 4,228,724 | 10/1980 | Leich | 86/26 |
| 4,329,906 | 5/1982 | Heers | 86/23 |
| 4,331,063 | 5/1982 | Schaenzer | 86/36 |
| 4,332,185 | 6/1982 | Hargrove | 86/23 |
| 4,343,222 | 8/1982 | Dillon | 86/38 |
| 4,393,744 | 7/1983 | Lee | 86/25 |

*Primary Examiner*—Teddy S. Gron
*Assistant Examiner*—Howard J. Locker
*Attorney, Agent, or Firm*—Fuller, House & Hohenfeldt

[57] ABSTRACT

A body having an axial bore is fixed in an ammunition cartridge reloading press which has an actuated ram. The bore contains a punch that is retracted by a spring away from a cartridge that is mounted in a holder and is to have a primer inserted. An open trough conducts primers in a row from a storage tray to a chamber at the upper end of the punch. A pin on the ram of the press drives the punch for it to press a primer into the cartridge in opposition to the spring. The terminal end of the trough is cylindrical and fits into the body's axial bore to allow the trough to pivot and advance primers by vibration. The terminal end has a hexagon bore to provide clearance for the round punch that passes through it so stray propellant dust can sift away safely. In one embodiment a rod extends laterally from the trough and rubs on the press frame during a ram stroke to thereby flex and vibrate the trough and tray to induce advancement of the primers.

10 Claims, 11 Drawing Figures

CARTRIDGE PRIMER FEEDER

BACKGROUND OF THE INVENTION

The invention pertains to a device for inserting primers in rifle and pistol ammunition cartridges using a standard upright loading press and standard shell holders.

Conventional press mounted priming tools have a tube filled with primers that are fed by gravity, one at a time, to a primer arm and then pushed into the cartridge. This creates an undue risk to the operator because all primers stacked within a tube are likely to explode if a single one is accidentally detonated. The consequences are self evident. Besides being unsafe, when the primers are stacked in a tube, they must be loaded into the tube one at a time. This is a slow process.

When large numbers of primers are inserted in cartridges, small quantities of priming propellant tend to dust off and accumulate in some parts of the press. In prior art reloading presses, this accumulation of explosive material presents a hazard, not so much in itself, but as an igniter for primers that are nearby.

In prior art ammunition cartridge reloading presses, the cartridge holders had to be of special design in order to provide guidance for the primers so they are aligned with the hole in the cartridge head to thereby, hopefully, avoid crushing of a live primer and accidental detonation.

SUMMARY OF THE INVENTION

In accordance with the invention, a primer insertion device is provided which avoids the use of a tube that has only end openings for containing the primers and, instead, provides an open-sided or pressure relieving channel for conveying the primers. Hence, if there should be accidental detonation of one primer the explosive force will be relieved without detonating other primers.

The new primer insertion device also provides for letting the propellant dust to sift out of the device. This is accomplished by using a round primer punch or drive pin and letting it pass through a hexagon-shaped hole to provide clearance for the primer dust. The primer punch is moved off of its seat with each primer insertion cycle so the dust can pass completely through the device instead of accumulating near the primers.

Another feature of the new primer insertion device is that it allows use of standard cartridge holders that are adaptable to a variety of different reloading press models. Thus, in accordance with the invention, no special guide means are needed for directing or guiding primers through the cartridge holder. A related feature is that in the new device, the primers are always accurately positioned on the end of the primer punch and they stay centrally located throughout the punch stroke so that the primers are seated accurately in the head of the cartridge every time.

Another feature of the new device is that the primers are stored in a tray which is similar to a tray used in U.S. Pat. No. 4,222,305 and is not basically new. However, the tray has been improved by, among other things, making it detachable from the channel by which the primers are now fed to the shell holder. This facilitates filling the tray with primers. After filling, it is then only necessary to gently shake the tray side-to-side to automatically turn the primers upright. After filling and vibrating the tray as just described, the cover for the tray can be applied and the tray reattached to the primer channel and then the priming operation can proceed.

In accordance with one embodiment of the primer tray and insertion device combination, the tray is carried on the primer feed channel and the channel is mounted to the insertion device body in a manner that permits it to be rotated through a small angle to thereby encourage advance of the primers down the channel to the tip of the punch where they are aligned with the primer receiving hole in the cartridge head.

In a modification of the invention, the primer feed channel is caused to be deflected or vibrated by a force derived from the moving ram of the reloading press.

The manner in which the above discussed features and objectives of the invention are achieved will be evident in the more detailed description of a preferred embodiment of the invention which will now be set forth in reference to the drawings.

DESCRIPTION OF A PREFERRED EMBODIMENT

Figure 1:
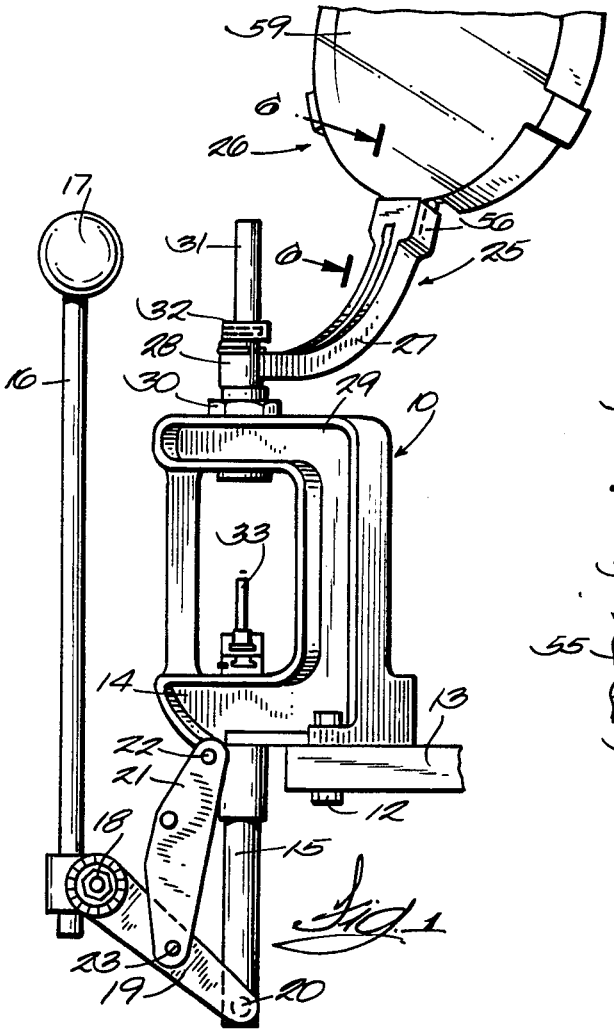
FIG. 1 is a side elevation view of a known type of upright ammunition reloading press in which the new primer insertion device is mounted.

The cartridge reloading press shown in FIG. 1 is basically the same as the press described in pending patent application Ser. No. 564,182, now U.S. Pat. No. 4,512,235, filed Dec. 22, 1983. The new priming device is mounted to the press in FIG. 1 as one example of its application. The press comprises an 0-frame 10 that is provided with laterally extending flanges 11 through which bolts 12 pass for mounting the press to the top 13 of a stable bench, for example. The base or bottom 14 of the 0-frame 10 has a vertical bore, not visible, in which a cylindrical ram 15 is guided for reciprocating vertically. The ram is driven by a manually actuated lever system including an arm 16 which has a manually engageable knob 17 on its free end. Arm 16 is clamped by means of a bolt 18 to a lever 19 which is an extension of operating lever 16. Lever 19 is pivotally connected at 20 to the bottom end of ram 15. A link 21 is pivotally connected at 22 to frame base 14 and also pivotally connected at 23 to lever 19. As is self evident, when operating arm 16 is rotated counterclockwise from the position in which it is shown in FIG. 1, ram 15 is driven upwardly. The lever system is similar to the one described in U.S. Pat. No. 4,393,744, which issued to the inventor in this application.

Referring to FIG. 1, the new primer inserting assembly is generally designated by the reference numeral 25. It comprises a primer storage tray 26 which has some of the characteristics of a tray shown in U.S. Pat. No. 4,222,305 but also has some new features as will be discussed in more detail later. Another major component of the primer insertion assembly is a curved channel trough 27 which couples to a generally cylindrical body 28. The lower part of body 28 is threaded into the top portion 29 of the 0-frame 10 and is locked against rotation with a lock nut 30. There is presently a cartridge 31 supported in a cartridge holder 32 that is coupled to body 28. It is assumed that the spent primer has been removed from the head end of cartridge 31 and it is ready to have a new live primer inserted in it. There is a primer punch driving pin 33 mounted to the upper end of ram 15. This punch can be driven upwardly by actuating the ram so it enters body 28 for the purpose of actuating the primer setting punch 34 which can be seen clearly in FIG. 2.

Figure 2:
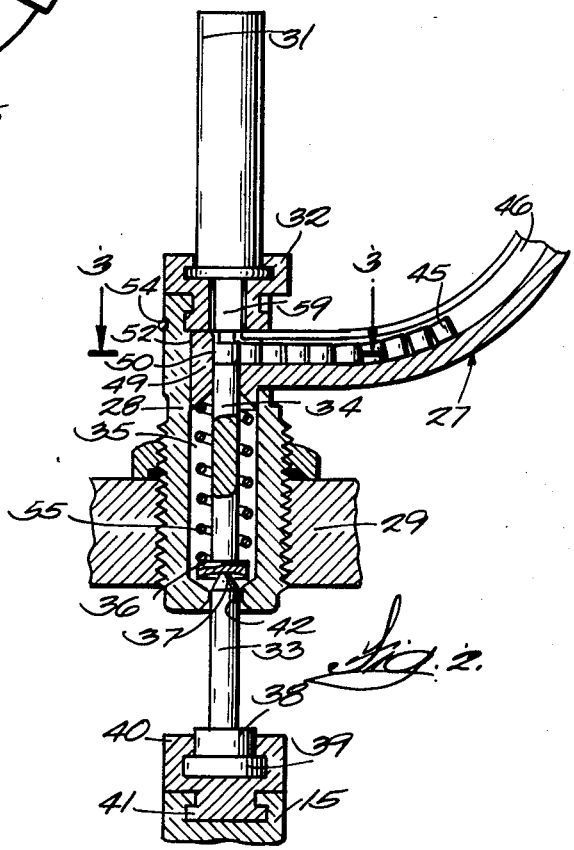
FIG. 2 is a partial vertical section of the primer insertion device, illustrating the body, the primer insertion punch, the cartridge holder, and a fragment of the curved cartridge feed channel.

Refer now to FIG. 2 where the primer insertion assembly is shown in greater detail. Here one may see that the externally threaded cylindrical body 28 has an axial bore 35 that is concentric to axially movable primer driving or setting punch 34. Punch 34 has a head 36 fixed on its lower end and the lower surface of this head is concave as is evident from inspection of FIG. 2. Pin 33, which is carried on ram 15 has a pointed tip 37 which centers in the concave recess in the head 36 of punch 34. The point 37 on pin 33 tends to center itself with the center of the concave recess to thereby maintain good alignment between the axes of drive pin 33 and primer setting punch 34. Pin 33 has a generally T-shaped head 38 on its lower end which fits into a complementarily shaped slot 39 in a retainer 40 that is like a standard shell or cartridge holder. Retainer 40 is secured in the upper end of ram 15 by means of a dovetail extension 41 that slides into a complementarily shaped slot in the upper end of ram 15.

Drive pin 33 extends through a hole 42 in the bottom end of threaded body 28 with some clearance. The clearance is great enough for propellant dust to pass through.

Figure 5:
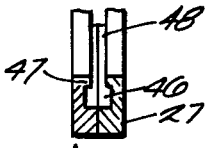
FIG. 5 is a vertical section through the primer insertion channel taken on a line corresponding with 5—5 in FIG. 4.
Figure 7:
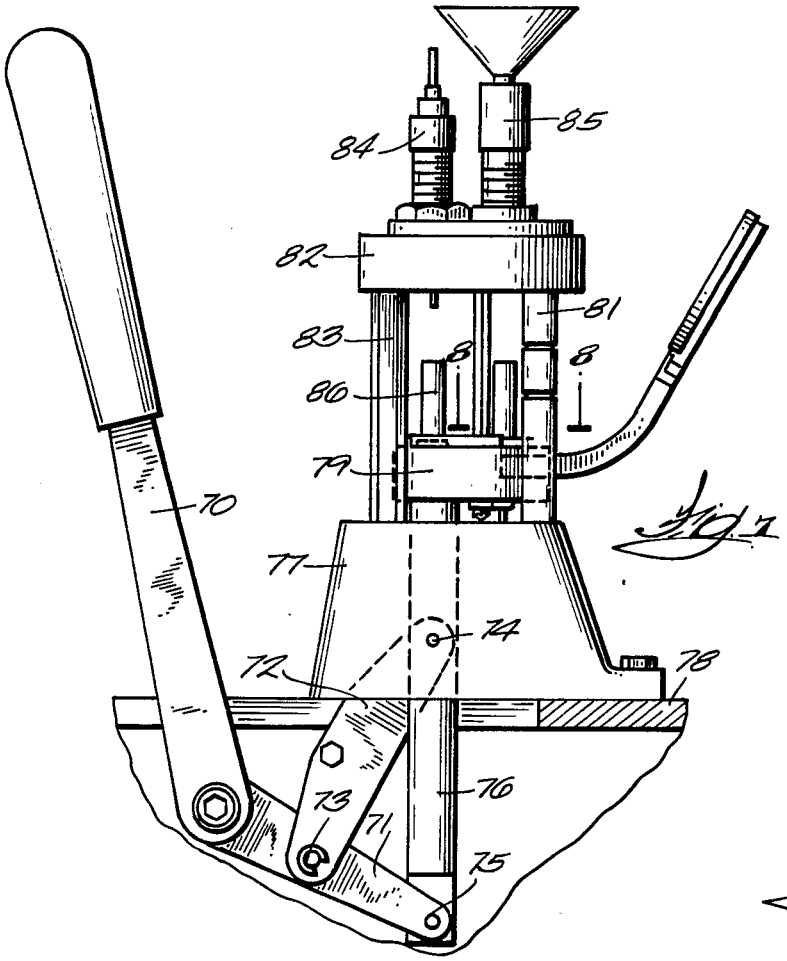
FIG. 7 illustrates another type of manually operated, bench mounted reloading press to which the new primer insertion device is mounted.

In FIG. 2, channel or trough 27 is occupied by some primer caps 45. These caps have passed down from the upwardly angulated primer storage tray 26 which appears in FIG. 1. A cross-section of channel 27 is shown in FIG. 5. The primers 45 move along the channel passageway 46 as can be seen in FIG. 5. In this particular design, the passageway 46 is overhung by a pair of shoulders or rims 47 that are spaced from each other to create an open slot 48 in the channel. If any of the primers 45 detonate accidentally, the resulting hot gases thereby produced can vent out of the slot 48 so as to relieve the heat and pressure that might otherwise detonate other primers in the channel. In another embodiment, see FIG. 9, the slot has the same width as the channel passageway 46; that is, shoulders 47 are omitted and the primers that are in transport are retained and covered by a thin fragile tape 89 that is adhered to the open side of the channel. The tape 89 assures that the primers will be retained in the channel but the tape will rupture to fully relieve pressure that would result from any accidental detonation of a primer so that other primers will not get hot and explode.

Figure 3:
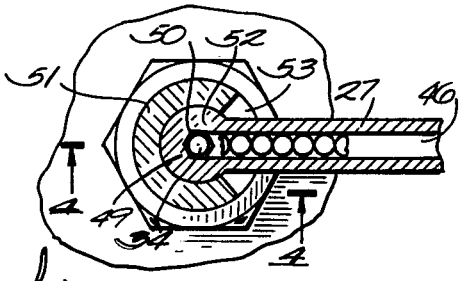
FIG. 3 is a transverse section taken on a line corresponding with 3—3 in FIG. 2.
Figure 4:
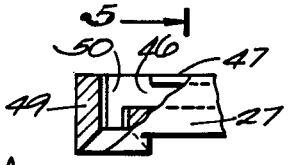
FIG. 4 is a vertical section through the end of the cartridge feed channel that is captured in the body of the primer insertion device, said section being taken on a line corresponding with 4—4 in FIG. 3.

As can be seen in FIGS. 2 and 4 particularly well, channel or trough 27 terminates in a cylindrical portion 49 which has a central hole 50 that is connected with primer passageway 46. Hole 50 is not round but is hexagonal in cross-section. As can be seen in FIGS. 2 and 3, primer setting punch 34 is round and passes through hexagonal hole 50, thus leaving clearance around the punch for propellant which may have dusted off of the primers to pass freely into bore 35 of body 28 and then out of the body through the clearance 42 around drive pin 33 which was previously mentioned.

As can be seen in FIGS. 2, 3 and 4, the upper end portion 51 of cylindrical body 28 has a cylindrical interior and a central bore 52 into which the cylindrical termination 49 of the channel 27 fits. End 51 of the body 28 has an open sector or side slot 53 through which the channel passes. This open sector allows the channel and the primer tray 26 to be pivoted through a small angle about a vertical axis by the hand of the user to thereby impose a vibrating force on the timers 45 for encouraging their flow in an uninterrupted stream down the channel 27 passageway 46. Observe in FIGS. 2, 3 and 4 that the hexagonal hole 50 in the cylindrical channel or trough termination 49, through which the punch 34 passes, is the same width as passageway 46 in the trough. Hence, the primers 45 are directed into hole 50 exactly centrally of punch 34 and each primer stays centered until it is set because no outside forces act on the primer other than the upward force of the ram. Thus, the space above the upper end of punch 34 in hexagon hole 50 constitutes a primer alignment chamber. In prior art primer inserters, the primers are fed through the cartridge holder which means that the holder must be other than a standard type since it must be provided with guide passageways for the primers. Feeding the primers directly to the top end of punch 34 in hexagon hole 50 and under the cartridge holder 32 and in alignment with hole 59 which is present in the standard cartridge holder anyway, obviates the need for any additional guide slots in the holder according to the invention.

In FIG. 2 one may see that at the top end of body 28 the shell holder 32 makes a dovetail connection with the body 28 and, thus, serves as a hold-down device for the termination 49 of the channel. Cartridge holder 32 is frictionally retained by the end of snap ring 54. By sliding holder 32 out of its slot in the body, the cylindrical terminal end 49 of the channel is freed for lifting it out of the body 28.

FIG. 2 shows that the bottom end of cylindrical portion 29 of the channel has a conical shape to provide a shoulder. A spring 55 is interposed between this shoulder and the head 36 of punch 34 so that the punch is retracted downwardly when it is not being forced upwardly by drive pin 33 on ram 15.

Figure 6:
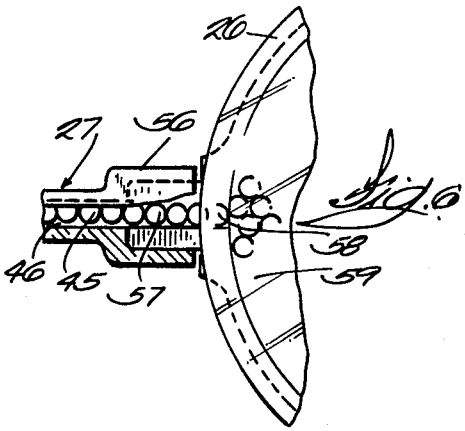
FIG. 6 is a partial transverse section taken on a line corresponding to 6—6 in FIG. 1 for illustrating how the primer storage tray is detachably coupled to the primer feed channel or trough.

In FIG. 1, one may see that the upper end 56 of curved channel 27 is enlarged to form a socket that is closed on all four sides but open at its end. A plan view of the socket 56 is shown in FIG. 6. Here one may see that the primer storage tray 26 is provided with a trough-like extension or spout 57 which is aligned with a hole 58 in the primer storage tray so the primers can pass out of the tray and into the trough and continue in the passageway 46 of channel 27. The spout of the tray fits snugly into socket 56 and permits the tray to be coupled to and uncoupled from channel 27 conveniently. This arrangement makes it convenient for refilling the primer tray 26 in which case the primer tray spout 57 is withdrawn from socket 56 so the primer tray can be laid on a table for having primers poured into it after its cover 59 is removed. Then when the primer tray cover is replaced, the spout can simply be plugged into the socket 56 of channel 27.

In FIG. 2, one of the primers 45 is presently aligned with the bore 59 in cartridge holder 32. This being a standard cartridge holder, the bore 59 is substantially larger in diameter than the diameter of the primers. The primers come down the channel 27 passageway 46 and rest on the flat or square upper end of punch 34, as previously explained, and they stay there centrally located and in perfect alignment with the deprimed hole in the cartridge head even though the punch 34 is in motion.

Use of the new primer insertion device is simple and convenient. Assuming that the body 28 is screwed into the top of press frame 29 and the channel is extending from it, the first thing to do is fill the tray 26 with a layer of primers. The spout 57 of the tray is then plugged into socket 56 on the input end of the channel 27 since the body of the tray is comparable to the tray shown in U.S. Pat. No. 4,222,305. The tray bottom has a multiplicity of concentric grooves which, when the tray is shaken, cause the primers to stand upright and properly oriented for coming down the channel so that their axes become aligned with the axis of the bore 59 in the cartridge holder 32. A cartridge is inserted in holder 32 while ram 15 is retracted so that primer setting punch 34 is also retracted or pressed downwardly by spring 55. A primer will be in the hexagonal bore 50 of the terminal end 49 of the channel. Then by driving the ram 15 upwardly, punch 34 will advance upwardly and set the primer in the head end of cartridge 31. Ram 15 and, hence, punch 34 are then retracted so as to admit another primer to the hexagonal chamber or bore through which the circular punch 34 slides. The ram is then reciprocated upwardly again to set the next primer in a cartridge. As indicated earlier, if fine propellant dusts off of the primers it will be discharged downwardly along punch 34 by reason of the punch being round and fitting through a hexagonal bore 50 which provides the clearance for letting the dust pass through and yet provides six flat sides of the hexagon that fit with little clearance against the punch 34 periphery so that the punch is sure to be guided for straight line movement without wobbling. In this embodiment, to assist in shaking primers down the passageway 46 in channel 27 the user can periodically swing the channel about the axis of the cylindrical terminal end 49 which is captured in the holder 28. Since presses such as shown in FIG. 1 are usually mounted firmly on a steady bench top there is relatively small probability that there will be enough vibration to cause positive advancement of the primer at all times. Hence, the capability of vibrating the primer tray and feed channel is provided in accordance with the invention.

Figure 8:
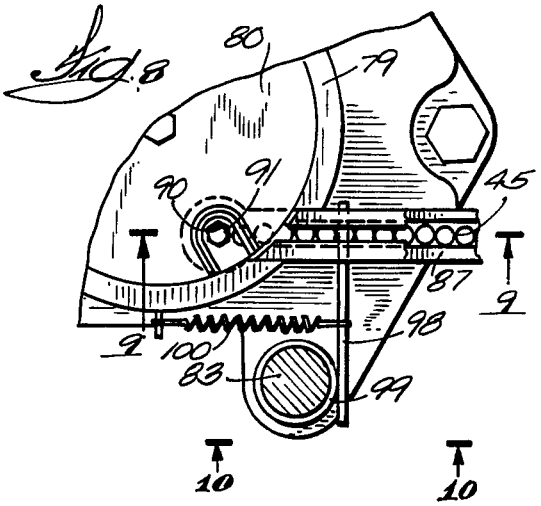
FIG. 8 is a fragmentary plan view, partially in section, of the region of the device lying along the plane 8—8 in FIG. 7.
Figure 10:
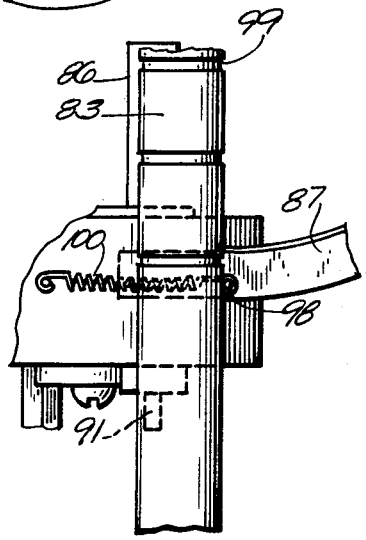
FIG. 10 is a fragmentary side elevation view looking in the direction indicated by the arrows 10—10 in FIG. 8.
Figure 9:
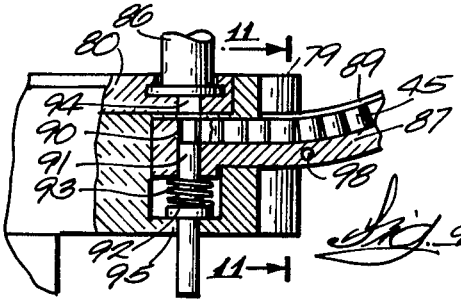
FIG. 9 is a vertical section taken on a line corresponding with 9—9 in FIG. 8.
Figure 11:
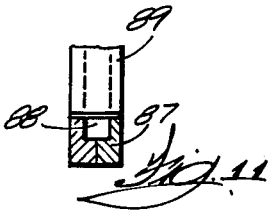
FIG. 11 is a vertical section taken through the primer feed channel on a line corresponding with 11—11 in FIG. 9.

Another application of the new primer inserting device will now be discussed in connection with another type of manually operating cartridge reloading press that is depicted in FIGS. 7–11. This press is similar to the press described in applicant's pending application Ser. No. 525,101, filed Aug. 22, 1983. The press has an operating lever and linkage system comprised of arm 70, lever extension 71, link 72 and pivots 73, 74 and 75 which are comparable to arm 16, lever extension 19, link 11 and pivots 22, 23 and 20 in the FIG. 1 embodiment. The FIG. 7 embodiment also has a ram 76 which is vertically reciprocable in a base 77 which is bolted to a bench top 78. In the FIG. 7 press, there is a cylindrical body 79 mounted to ram 76. A turret 80 is mounted for rotation in body 79 and is driven rotationally by being advanced along a hexagonal rod 81 as is described in greater detail in the cited pending application. The FIG. 7 press has a head 82 supported on posts 83. Dies such as the one marked 84 for driving out spent primer caps and a die 85 for pouring powder into cartridges that are being reconditioned are mounted in head 82. Some cartridges 86 are presently mounted in rotatable turret 80 and they are rotated or orbited in a step-by-step fashion having the various cartridge reloading operations performed on them by driving forces resulting from actuating operating lever 70. In the FIG. 7 embodiment, the primer storage tray is similar to the tray in the FIG. 1 embodiment and is given the same reference numeral 26. The channel or trough for conducting the primers from the tray to the turret is marked 87 and it differs slightly in construction from the corresponding channel 27 in the FIG. 1 embodiment. FIGS. 8 and 9 clarify how the channel 87 engages with the vertically reciprocable body 79 that contains the rotatable cartridge-supporting turret 80. As can be seen in FIG. 11, which shows a cross-section of the channel 87, the channel is provided with a groove 88 constituting a passageway for primers. In this case the groove is covered with a pressure sensitive adhesive tape 89 which retains primers in the groove but can blow out or relieve pressure if a primer detonates so a detonation chain reaction is prevented.

As shown in FIGS. 8 and 9, the end of channel 87 has a hexagon hole 90 through it and a round primer setting punch 91 fits through this hole and retains the channel 87 in the body 79 in which the cartridge-supporting turret 80 rotates. Punch 91 has a shoulder 92 and there is a spring 93 interposed between the bottom of the channel termination and the shoulder 92 for retracting punch 91 to its lowermost position. When the body 79 is driven downwardly by means of the ram until the lower end of punch 91 strikes the top of press base 77, the punch 91 is forced upwardly to advance a primer through a hole 94 in the turret and into the head of cartridge 86. Punch 91 is prevented from being driven out of the holder by the force of spring 93 by letting shoulder 92 on the stop abut against a bored plug 95. The hole 90 through the end of channel 87 is hexagonal and the punch 91 is round as in the previously discussed embodiment to create a passageway for releasing propellant which may dust off of the primers to obtain the advantages described in connection with the previous embodiment.

In the FIG. 7–11 embodiment, the channel 87 is automatically vibrated to assure advancement of primers along the channel passageway. As can be seen in FIGS.

8, 9 and 10, to accomplish vibration a rod 98 passes through the bottom of the channel and extends laterally of it. One of the posts 83 of the press is provided with vertically spaced-apart grooves such as the one marked 99 that appears in hidden lines in FIG. 8. As the ram 76 and the body 79 thereon are raised and lowered, laterally extending rod 98 rubs along the sides of post 83 and runs in and out of the grooves so that there is a vibrating force transmitted through rod 98 to channel 87. These vibrations assure that the primers 45 will advance along the channel passageway without having gaps develop between them. In this embodiment, a spring 100 is provided for pulling rod 98 toward the grooves 99 as can be seen in FIGS. 8 and 10. In another embodiment, not shown, the channel 87 is molded of a plastic material which is rigid but will flex or bend slightly without cracking. For example, the channel can be molded of nylon which has these physical characteristics. In such case, the rod 98 is chattered or vibrated by passing over the grooves 99 but spring 100 is dispensed with since the rod and channel are springy enough to impart a vibratory force to the primers which advances them in the channel passageway.

I claim:

1. A cartridge primer insertion device for use in a press including a ram that is movable in axially opposite directions and a holder for retaining a cartridge while a primer is being inserted, said device comprising:

a trough defining a curved passageway having an upper end into which a series of primers are fed to the passageway and a lower end at which the first in the series of primers exits from the passageway while moving along a horizontal line under the gravitational force exerted by primers above said first primer in the series, an element joined with said trough at said lower end of the passageway, said element having a hole whose axis is perpendicular to said horizontal line and whose width is sufficient to accommodate the width of only one primer, said hole having an open side contiguous with said lower end of said passageway such that when said first primer exits the passageway said primer arrives directly and centrally in said hole, and a punch member arranged coaxially with said hole and movable through said hole and spring means arranged for retracting said punch member to a position where its nominally upper end is no higher than said lower end of the passageway to thereby enable a primer that has exited from the passageway to be deposited directly on said upper end, said punch being driven in one direction in response to movement of said ram in one direction to thereby insert said primer on the end of the punch in said cartridge retained in said holder.

2. The device according to claim 1 wherein said hole in said element is polygonal in cross-section and said punch is circular in cross-section to thereby create spaces at the corners of the polygon for explosive propellant that may dust off of the primers to sift through to thereby prevent the dust from accumulating in proximity to the primers.

3. The device according to claim 1 including means for vibrating said trough to induce advancement of primers along said passageway.

4. The device according to claim 1 including:

a cylindrical body adapted for being mounted in said press and having an axial bore, said element at the end of said trough having a cylindrical exterior for fitting concentrically into the bore in the body and said body having a radially extending opening in it through which said trough extends to said element, said opening being wider than the width of said trough so said trough can be rotated about the axis of said element to a limited extent in opposite directions to thereby create a vibratory action that induces advancement of primers along said passageway.

5. The device according to claim 4 wherein:

said holder has a bore whose diameter is larger than the diameter of said punch, means for attaching said holder to said body with said bore axially aligned with said punch and with said holder disposed over said cylindrical element to thereby retain said element in said body.

6. The device according to any one of claims 1, 2, 3, 4 or 5 including:

tray means for storing primers, said tray means having spout means extending therefrom, said spout means having a passageway for exiting primers, said trough having a socket means formed on said upper end into which said spout is insertable for its passageway to align with said primer passageway in said trough and from which said spout is withdrawable to separate the tray from the trough.

7. The device according to claim 6 wherein said tray means comprises a circular wall joined with a substantially planar bottom, the curvature of said trough being such that said tray bottom is at an angle relative to horizontal to let the force of gravity feed the primers out of the tray through said spout into the passageway of said trough.

8. Apparatus according to claim 1 wherein:

said element at said lower end of said trough is clamped to said ram of said press so said element and the trough for conducting primers will move up and down with the ram, rod means extending from said trough in a direction generally transverse to the line of movement of the ram, said press having a part in which there are irregularities in its surface vertically spaced apart along the path of movement of said rod means, said rod means rubbing against said irregularities as said rod means moves to thereby vibrate said trough to induce the flow of primers through the trough.

9. The device according to any one of claims 1, 2, 3, 4 or 5 wherein said trough is comprised of a bottom and upstanding spaced apart sides defining a trough having an open slot substantially coextensive with the length of said trough, said slot providing relief of pressurized hot gases that would otherwise build up if a primer is accidentally detonated.

10. The device according to claim 9 including a tape adhered to said trough and covering the slot for retaining the primers in said trough, said tape being sufficiently weak to fracture or peel off to relieve said gases resulting from accidental detonation.

* * * * *